US010843831B2

(12) United States Patent
Webb

(10) Patent No.: US 10,843,831 B2
(45) Date of Patent: Nov. 24, 2020

(54) PACKING CASE ERECTION

(71) Applicant: QUIN SYSTEMS LIMITED, Wokingham (GB)

(72) Inventor: Michael Webb, Fleet (GB)

(73) Assignee: Quin Systems Limited, Wokingham (GB)

( * ) Notice: Subject to any disclaimer, the term of this patent is extended or adjusted under 35 U.S.C. 154(b) by 328 days.

(21) Appl. No.: 15/565,354

(22) PCT Filed: Apr. 11, 2016

(86) PCT No.: PCT/GB2016/050994

§ 371 (c)(1),
(2) Date: Oct. 9, 2017

(87) PCT Pub. No.: WO2016/162691

PCT Pub. Date: Oct. 13, 2016

(65) Prior Publication Data

US 2018/0072444 A1 Mar. 15, 2018

(30) Foreign Application Priority Data

Apr. 10, 2015 (GB) ..... 1506155.9

(51) Int. Cl.
*B65B 43/18* (2006.01)
*B65B 43/26* (2006.01)
(Continued)

(52) U.S. Cl.
CPC ..... *B65B 43/185* (2013.01); *B65B 43/265* (2013.01); *B65B 43/305* (2013.01); *B31B 50/062* (2017.08); *B31B 50/804* (2017.08)

(58) Field of Classification Search
CPC ... B65B 43/185; B65B 43/265; B65B 43/305; B31B 50/804; B31B 50/062
(Continued)

(56) References Cited

U.S. PATENT DOCUMENTS 4,035,989 A * 7/1977 Schuster ..... B65B 7/22 53/566
4,998,910 A * 3/1991 Mohaupt ..... B31B 50/00 493/12
(Continued)

FOREIGN PATENT DOCUMENTS

DE 20313717 U1 1/2004
DE 20321592 U1 4/2008
(Continued)

OTHER PUBLICATIONS

International Search Report dated Sep. 8, 2016 for PCT/GB2016/162691.

*Primary Examiner* — Robert F Long
*Assistant Examiner* — Xavier A Madison
(74) *Attorney, Agent, or Firm* — Christopher M. Ramsey; GrayRobinson, P.A.

(57) ABSTRACT

A gripper having jaws (11,12) is transported from a first position (FIG. 2) in which it grips a case blank (1) in a flat, folded condition to a second position (FIG. 4) in which the case (8) is erected. Gripping devices (13) on the jaws (11,12) are aligned with one another when the gripper is in its first position. The gripping devices (13) on the jaws (11,12) are oriented at right angles to one another when the gripper is in its second position. Mutual rotation is effected between the jaws (11,12) as the gripper is moved from its first to its second position, in order to unfold a case blank (1) gripped by the gripper jaws (11,12).

24 Claims, 9 Drawing Sheets

(51) Int. Cl.
*B65B 43/30* (2006.01)
*B31B 50/80* (2017.01)
*B31B 50/06* (2017.01)

(58) Field of Classification Search
USPC ..... 53/458; 493/309, 313, 316
See application file for complete search history.

(56) References Cited

U.S. PATENT DOCUMENTS

| | | | | |
|---|---|---|---|---|
| 5,207,630 | A * | 5/1993 | Decker | B31B 50/80 493/313 |
| 5,957,825 | A * | 9/1999 | Marchetti | B31B 50/00 493/309 |
| 6,913,568 | B2 * | 7/2005 | Frank | B31B 50/80 493/309 |
| 7,131,941 | B2 * | 11/2006 | Makar | 493/309 |
| 7,510,517 | B2 * | 3/2009 | Goodman | 493/313 |
| 7,708,678 | B2 * | 5/2010 | Monti | B65B 43/265 493/309 |
| 9,126,380 | B2 * | 9/2015 | Dittmer | B31B 50/00 |
| 2004/0138039 | A1 | 7/2004 | Mazurek | |
| 2009/0239726 | A1 | 9/2009 | Huang | |

FOREIGN PATENT DOCUMENTS

| | | |
|---|---|---|
| WO | 198900132 | 1/1989 |
| WO | 2004014730 A1 | 2/2004 |

* cited by examiner

PACKING CASE ERECTION

CROSS-REFERENCE TO RELATED APPLICATIONS

This is the U.S. National Stage entry of International Application No. PCT/GB2016/050994, filed Apr. 11, 2016, which claims priority to GB Application No. 1506155.9, filed Apr. 10, 2015. These prior applications are incorporated herein by reference in their entirety.

FIELD

The present invention relates to the erection of packing cases.

BACKGROUND

Many products are packed in cardboard packing cases (cardboard boxes or cartons) that are typically stacked in a flat configuration, ready to be unfolded, erected and filled with products. In automated packing plants, the process of unfolding and erecting a packing case has been automated to a degree. However, in known case erecting apparatus, movement of the case is often interrupted between stages of operation, for flaps to be folded, and to transfer the case from one mechanism to another for different processes to be effected.

BRIEF SUMMARY

Preferred embodiments of the present invention aim to provide improved packing case erecting apparatus that can be operated more quickly, without pausing between stages of operation and with several processes effected within the same apparatus.

According to one aspect of the present invention, there is provided a packing case erecting apparatus, comprising:

a gripper having first and second jaws and gripping devices carried on said jaws and arranged to grip a case blank in a flat, folded condition;

a transport mechanism arranged to transport the gripper from a first position in which it grips the case blank in a flat, folded condition to a second position in which the case is erected; and a rotation mechanism that is arranged to cause mutual rotation between said first and second jaws:

wherein:

the gripping devices on said first and second jaws are aligned with one another when the gripper is in its first position;

the or each gripping device on said first jaw is oriented at a right angle to the or each gripping device on said second jaw when the gripper is in its second position; and the transport and rotation mechanisms are synchronised to cause mutual rotation between said first and second jaws as the gripper is moved from its first to its second position, thereby to unfold the case blank gripped by the gripper.

Preferably, said transport mechanism comprises a pair of struts, each having a driven end that is constrained to travel along a slideway.

Preferably, said transport mechanism is connected to said rotation mechanism.

The apparatus preferably comprises a linkage that connects said transport mechanism and said rotation mechanism and includes a cam follower that is arranged to follow a cam surface to synchronise mutual rotation between said first and second jaws with movement of the gripper between its first and second positions.

Preferably, said cam surface is arranged to move with a part of the transport mechanism.

Preferably, said gripping devices comprise vacuum suckers.

Preferably, said first and second jaws are pivotally connected to one another.

The apparatus preferably further comprises a hopper adjacent said first position, for containing a stack of case blanks in a flat, folded condition.

Preferably, said transport mechanism operates with two degrees of freedom such that movement of the gripper from its first position to its second position comprises movement in a first direction followed by movement in a second direction transversely of the first direction.

Preferably, said transport mechanism is connected to said gripper.

Preferably, said transport mechanism is servo driven.

The apparatus preferably further comprises one or more flap closing device arranged to close bottom flaps of an erected case as it is transported towards its second position.

Preferably, one said flap closing device comprises a plate mounted on a parallel linkage and arranged to support a rear flap of an erected case as it is transported towards its second position.

The apparatus preferably further comprises an adhesive applicator arranged to apply adhesive to bottom flaps of an erected case as it is transported towards its second position.

The apparatus preferably further comprises a compression plate adjacent said second position and arranged to apply pressure to closed, bottom flaps of an erected case at said second position.

Preferably, said compression plate comprises an upstand arranged to engage the bottom of an erected case at said second position.

The apparatus preferably further comprises a transport device arranged to transport said compression plate in synchronisation with said transport mechanism.

Preferably, said transport device is arranged to transport said compression plate such that said upstand entrains the bottom of an erected case at said second position and transports the erected case to a location for subsequent handling.

The apparatus preferably further comprises a case clamp and a fixed edge at said second position, arranged to clamp an erected case therebetween.

Preferably, said second position is a packing station at which products are packed in an erected case.

Preferably, the or each gripping device on at least one of said jaws is mounted for sliding movement along the jaw.

Preferably, said gripper grips a case along a side face and an end face of the case.

The invention also extends to a method of erecting a packing case, using an apparatus according to any of the preceding aspects of the invention, comprising the steps of gripping the case blank in a flat, folded condition at said first position and transporting the case blank to said second position whilst rotating said first and second jaws to erect the case.

Preferably, the method comprises the further step of packing products in the erected case when at said second position.

BRIEF DESCRIPTION OF THE DRAWINGS

For a better understanding of the invention, and to show how embodiments of the same may be carried into effect, reference will now be made, by way of example, to the accompanying diagrammatic drawings, in which:

FIG. 2 illustrates an initial stage thereof, FIG. 3 illustrates a subsequent stage thereof, FIG. 4 illustrates a subsequent stage thereof, FIG. 5 illustrates a subsequent stage thereof, FIG. 6 illustrates a subsequent stage thereof, FIG. 7 illustrates a subsequent stage thereof, FIG. 8 illustrates a subsequent stage thereof, FIG. 9 illustrates a subsequent stage thereof, FIG. 10 illustrates a subsequent stage thereof, FIG. 11 illustrates a subsequent stage thereof, FIG. 12 illustrates a subsequent stage thereof, FIG. 13 illustrates a subsequent stage thereof, FIG. 14 illustrates a subsequent stage thereof, FIG. 15 illustrates a subsequent stage thereof, FIG. 16 illustrates a subsequent stage thereof, FIG. 17 illustrates a subsequent stage thereof.

In the figures, like references denote like or corresponding parts.

DETAILED DESCRIPTION OF EXAMPLE EMBODIMENTS

Figure 1:
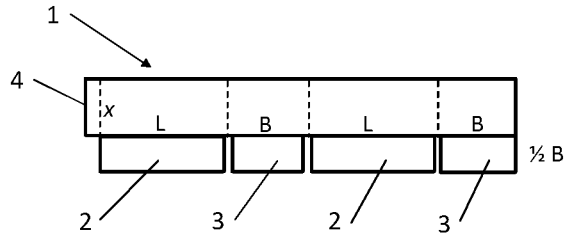
FIG. 1 illustrates a standard FEFCO 0200 packing case, both as a blank and as a partially erected case.

It is to be understood that the various features that are described in the following and/or illustrated in the drawings are preferred but not essential. Combinations of features described and/or illustrated are not considered to be the only possible combinations. Unless stated to the contrary, individual features may be omitted, varied or combined in different combinations, where practical.

The cardboard packing case 1 that is shown in FIG. 1 is one of the most common configurations of packing cases known by the code FEFCO 0200. FEFCO is the Federation Européenne des Fabricants de Carton Ondule and is generally regarded as providing international standard guides to the design of packing cases (cardboard boxes or cartons). The packing case 1 has an open top. FEFCO 0201 is of a similar configuration, but with a closable top.

The packing case 1 has two longitudinal sides L, two lateral sides B and is of height H. As a blank, as shown at the top of FIG. 1, each of the sides L extends into a lower flap 2 and each of the sides B extends into a lower flap 3. In the following description, the flaps 2 will be referred to as side flaps and the flaps 3 will be referred to as front and rear flaps. A vertical flap 4 is formed at the left of the blank as seen and, in use, the flap 4 is glued to the inside of an adjacent short side B. This is often referred to as a 'manufacturer's joint'. Typically, the blank is supplied already folded in two at its centre fold with the flap 4 already glued to the respective short side B, ready for the case to be unfolded. The lower part of FIG. 1 shows the case 1 unfolded, with the side flaps 2 in the process of being folded upwardly, to be secured to the front and rear flaps 3, which have already been folded upwardly.

Referring to FIG. 1, a FEFCO 0201 blank will have flaps 2, 3 extending from the top as well as the bottom of the sides L, B (as seen).

Figure 2:
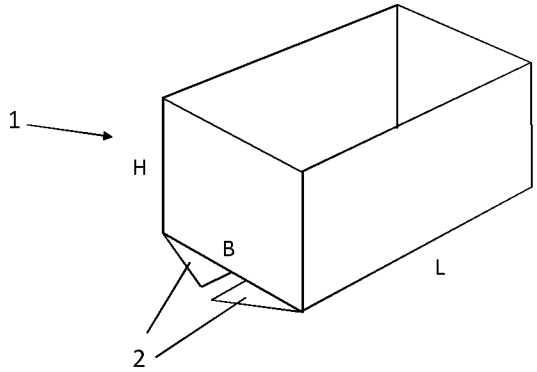
FIGS. 2 to 17 illustrate sequential stages of operation of a case erecting apparatus where
Figure 2:
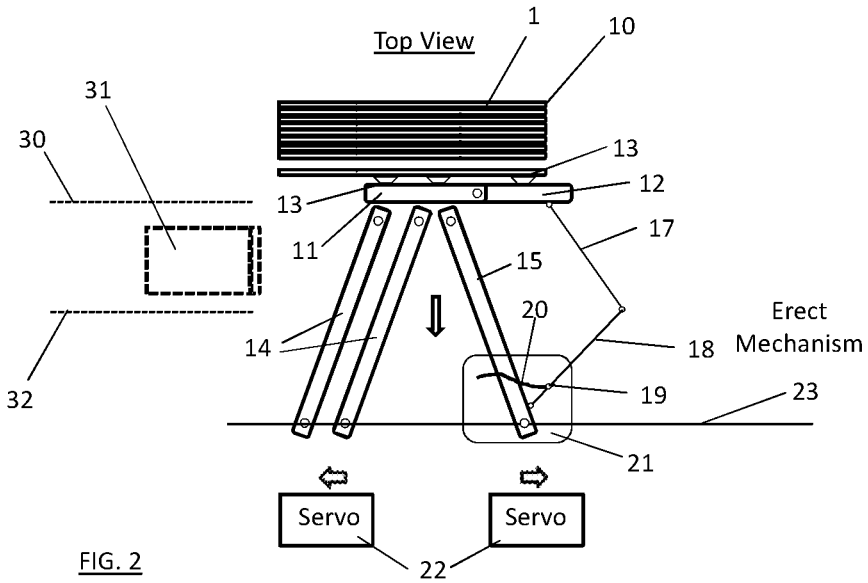

In FIG. 2, which shows packing case erecting apparatus, conveniently referred to herein as a case erector, from above, a stack of on-edge case blanks 1 as shown in FIG. 1 is loaded in a hopper 10, with the case blanks 1 in a flat, folded condition. Gripping devices in the form of vacuum suckers 13 are mounted on a gripper that comprises a first jaw in the form of a plate 11 and a second jaw in the form of an unfolding arm 12, which are pivotally connected together and pivotally mounted at respective ends of first and second struts 14, 15. As shown diagrammatically in FIG. 2, the plate 11 is supported on two parallel first struts 14, in order to maintain the plate 11 parallel to a slideway 23. However, to aid clarity, only a single first strut 14 is shown in subsequent figures.

First and second arms 17, 18 of a linkage are pivotally connected to the unfolding arm 12 and the second strut 15. A cam follower 19 is mounted on the second arm 18 and engages in a cam track 20 that is formed in a plate 21 to provide a cam surface. The plate 21 is pivotally connected to the second strut 15. A driven end of each of the struts 14, 15 is arranged to be driven independently, left and right (as seen) by a respective servo drive 22, along the slideway 23. The cam plate 21 travels with the driven end of the second strut 15.

The gripper comprising plate 11 and unfolding arm 12 with vacuum suckers 13 is shown in FIG. 2 in or adjacent a first, end position. The first and second struts 14, 15 and associated parts provide a transport mechanism. The linkage 17, 18 and associated parts provide a rotation mechanism.

In FIG. 2, the driven end of the strut 14 is being driven to the left (as seen) and the corresponding end of the strut 15 is being driven to the right, as indicated by respective arrows. The driven ends of the struts, 14, 15 are therefore being driven apart and this causes the opposite ends of the struts 14, 15 to move towards the slideway 23, as shown by a respective arrow, and for the gripper 11, 12 to be thus drawn away from the case hopper 10, taking a respective case blank 1 with it, held by the vacuum suckers 13.

FIG. 2 also shows a case clamp 30, a compression plate 31 and a fixed edge 32, which will be described further below.

Figure 3:
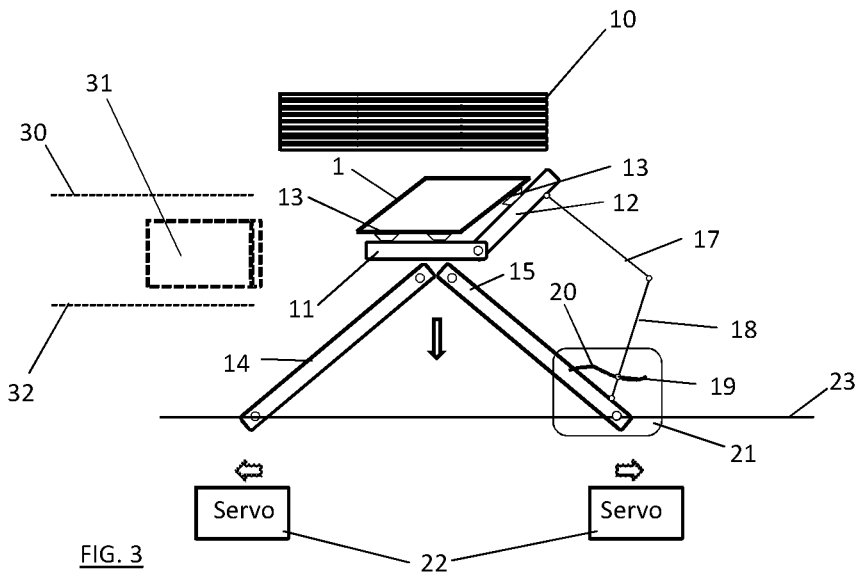

In FIG. 3, the driven ends of the struts 14, 15 have moved further apart and their opposite ends together with the gripper 11, 12 have moved further towards the slideway 23. During this movement, the unfolding arm 12 is pivoted counterclockwise (as seen) by the linkage 17, 18 constrained by the cam arrangement 19, 20. Since the case blank 1 is held firmly by the vacuum suckers 13, it begins to be unfolded, as seen in FIG. 3.

Figure 4:
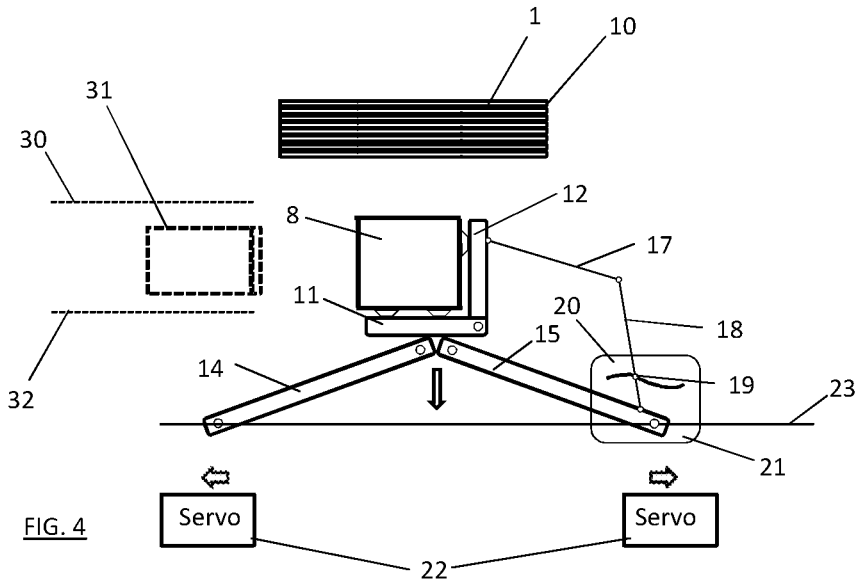

In FIG. 4, the opposite movement of the driven ends of the struts 14, 15 along the slideway 23 has completed and their opposite ends have likewise reached an end position. Counterclockwise movement of the unfolding arm 12 has also completed, constrained by the linkage 17, 18, such that it now makes a precise right angle with the unfolding arm 11. In particular, the vacuum suckers 13 on the unfolding arm 12 have moved from a position in which they were initially aligned with the vacuum suckers 13 on the first unfolding arm 11, to a position in which they are oriented at a right angle to the vacuum suckers 13 on the first unfolding arm 11. The case blank 1 has therefore been fully unfolded to form an open case 8 of accurate rectangular form in plan view. The respective vacuum sucker 13 is preferably mounted for sliding movement along the unfolding arm 12, to ensure an accurate right angle corner of the case 8.

Once the case 8 has been opened as shown in FIG. 4, it is necessary to fold up the side, front and rear flaps 2, 3.

Figure 5:
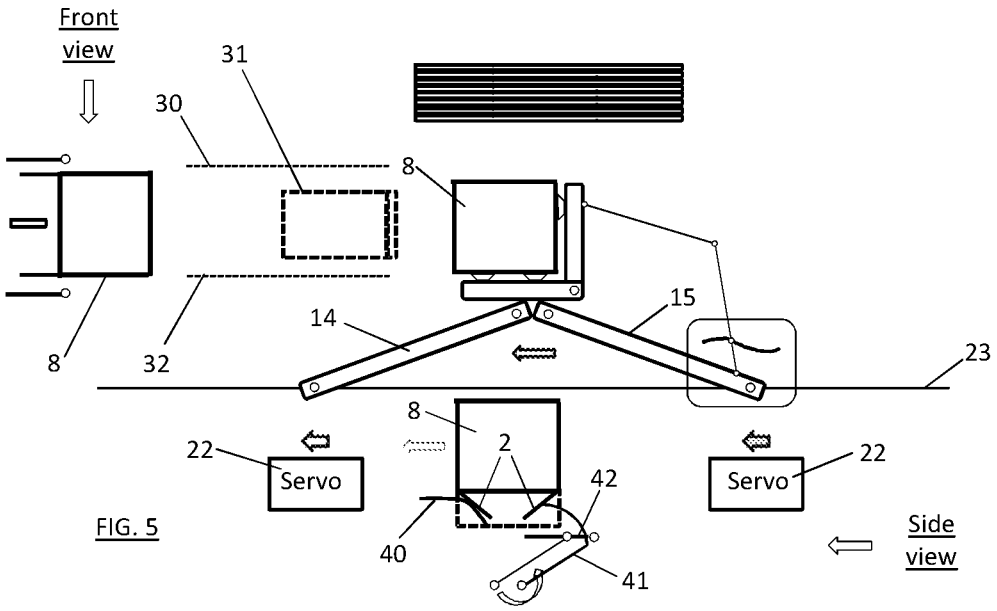

Firstly, as seen in FIG. 5, both servo drives 22 move the struts 14, 15 in unison to the left (as seen), to move the gripper 11, 12 and the unfolded case 8 towards the case clamp 30, compression plate 31 and fixed edge 32. In addition to the top plan view of the previous figures, FIG. 5 and following figures show a front view of the case 8 at the left of the figure and a side view in the lower part of the figure. As the case 8 moves to the left, the front flap 3 engages a fixed ramp 40, which folds the front flap 3 upwardly. At the same time, a rotating rear tucker 41 engages the rear flap 3 and folds it upwardly.

As may be seen in FIG. 5, the rear tucker 41 comprises a straight portion and a curved portion. Where those portions intersect, the rear tucker 41 connects with a pivotally mounted parallel link 42 that moves forward with the rear tucker 41 and provides a flat surface that remains parallel to the slideway 23, bridging the gap between the rear tucker 41 and the fixed ramp 40 to support the rear flap 3 whilst the side flaps 2 are folded upwardly, as explained below.

Figure 6:
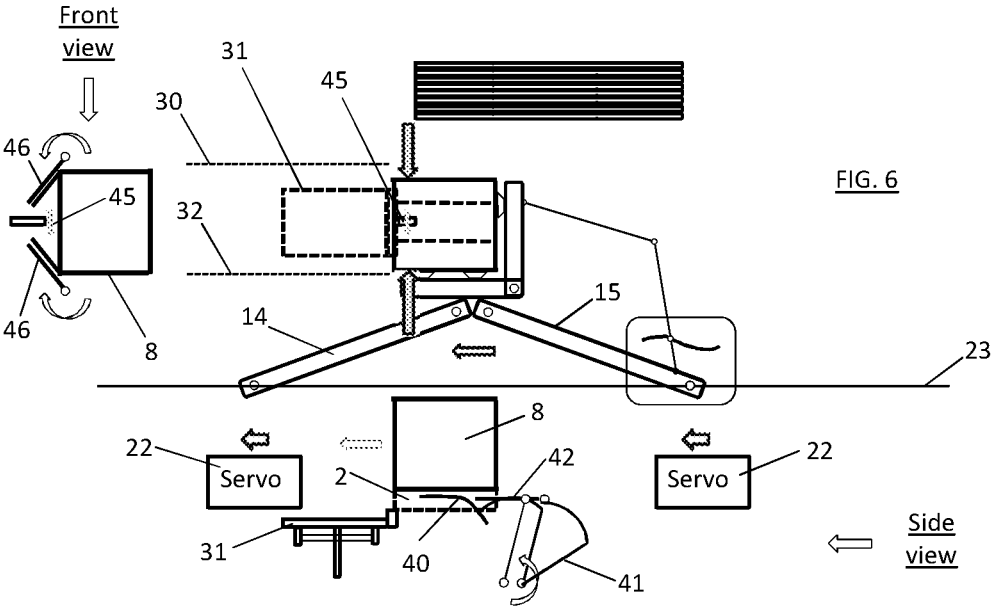
Figure 7:
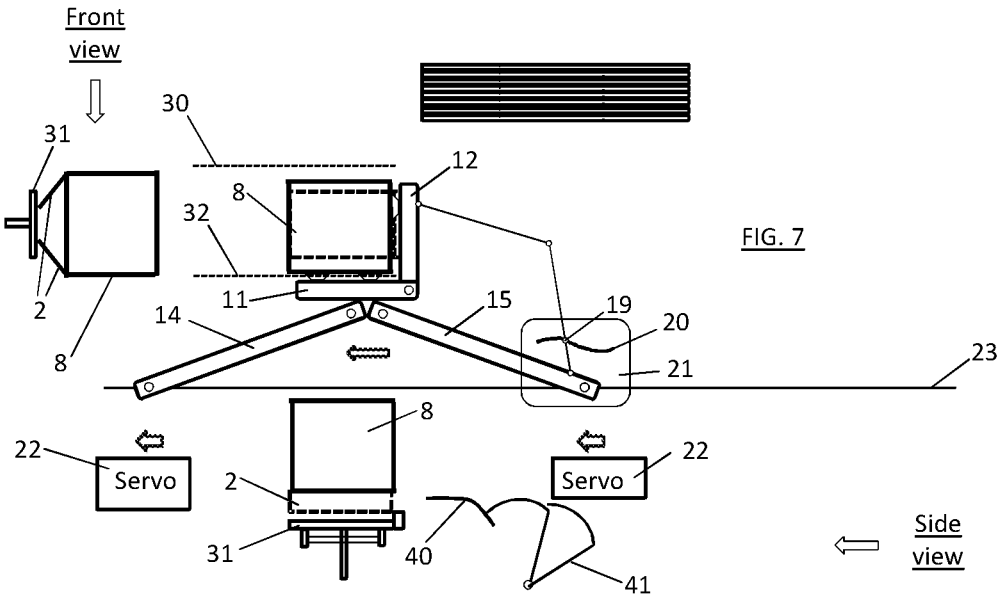

As the case 8 continues to move to the left, as shown in FIG. 6, the side flaps 2 are folded upwardly by side tuckers 46 and, as shown in FIG. 7, maintained in a semi-folded position by engagement with the compression plate 31, which is located under the open case 8. When in a semi-folded position, a spray nozzle 45 sprays glue onto the side flaps 2. FIG. 7 shows the struts 14, 15 and gripper 11, 12 in their leftmost positions, which is a second, end position for the gripper.

Figure 8:
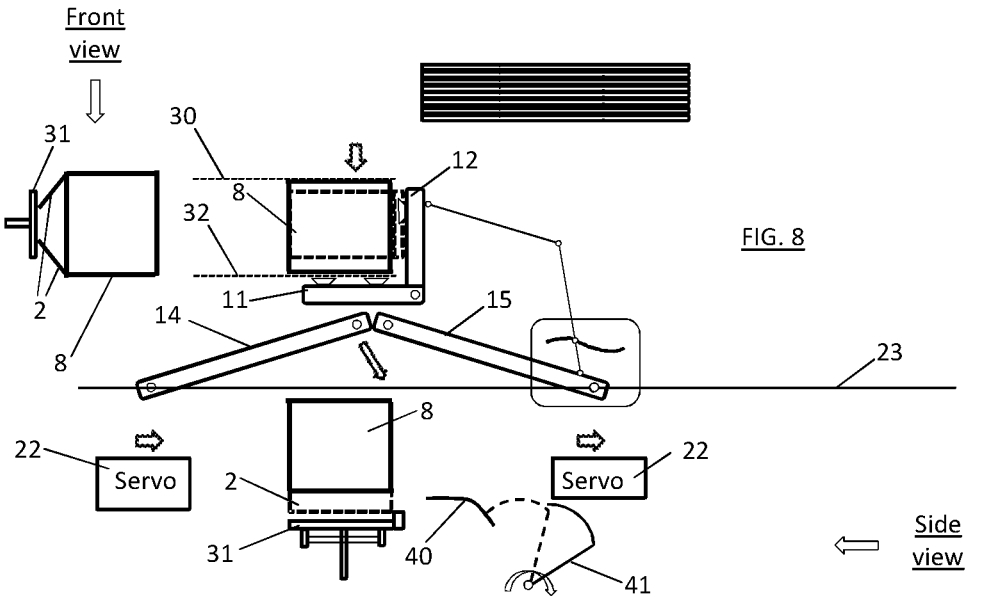

In FIG. 8, the case clamp 30 is brought to bear against the side of the case 8, to urge it against the fixed edge 32 and thereby hold it in position. The vacuum is then released at the suckers 13 and the driven ends of the two struts 14, 15 begin to move to the right, the strut 15 moving slightly in advance, to cause the opposite ends of the struts 14, 15 to move slightly towards the slideway 23, along with the gripper 11, 12. At this time, the rear tucker 41 is rotated clockwise back towards its initial position.

Figure 9:
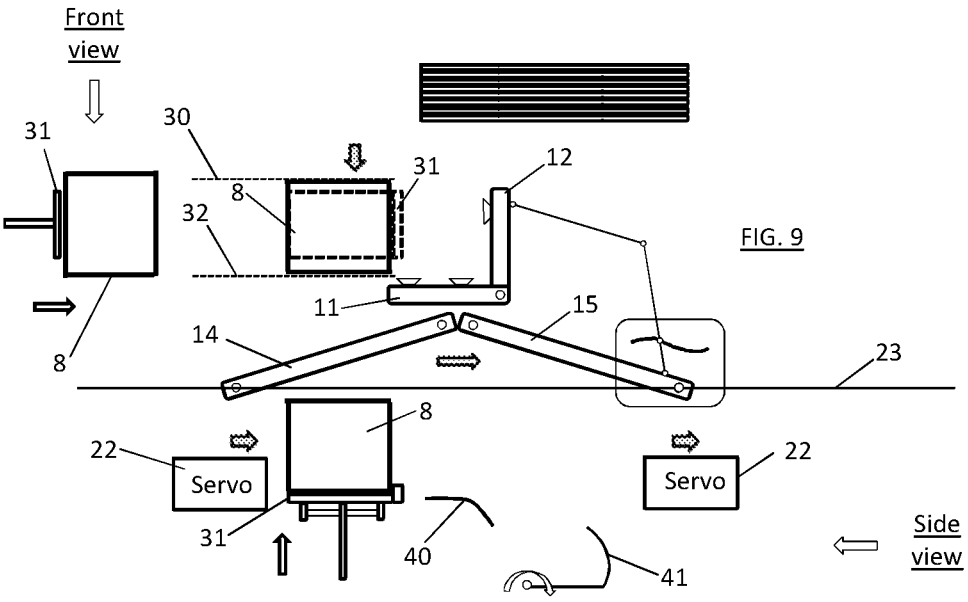

In FIG. 9, the struts 14, 15 and gripper 11, 12 continue to move to the right, whilst the compression plate 31 is raised to urge the pre-glued side flaps 2 upwardly into contact with the already folded front and rear flaps 3. If desired, another pressure plate can be applied from above to the flaps 2, 3 that are now in contact with one another, to ensure that the flaps 2, 3 are securely glued to one another. However, in a preferred arrangement, products are now packed automatically into the open case 8—e.g. by means of a pick and place robot—and the weight of the products serves to urge the flaps 2, 3 securely together. This obviates the need for applying pressure by another mechanism from above.

Figure 10:
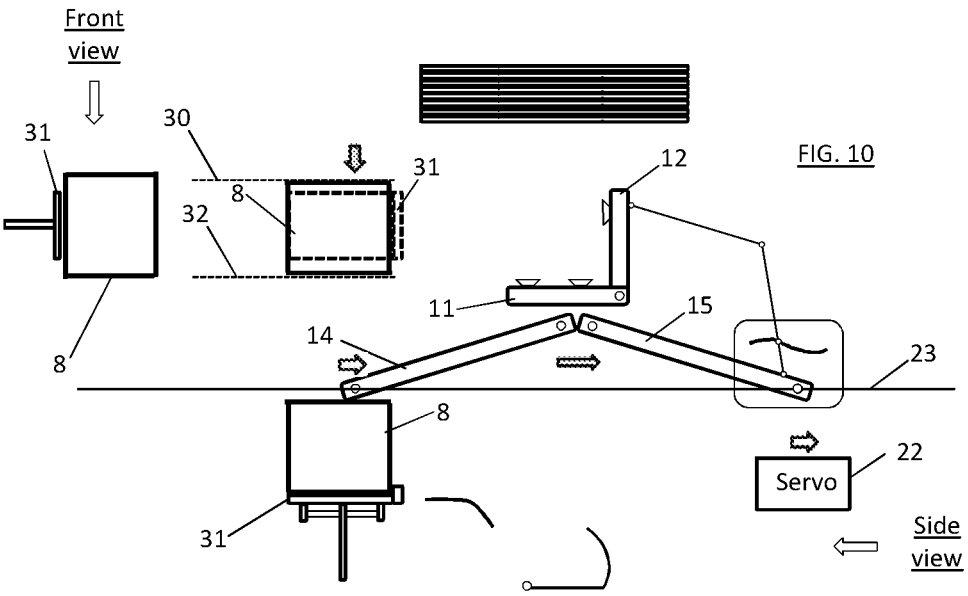
Figure 11:
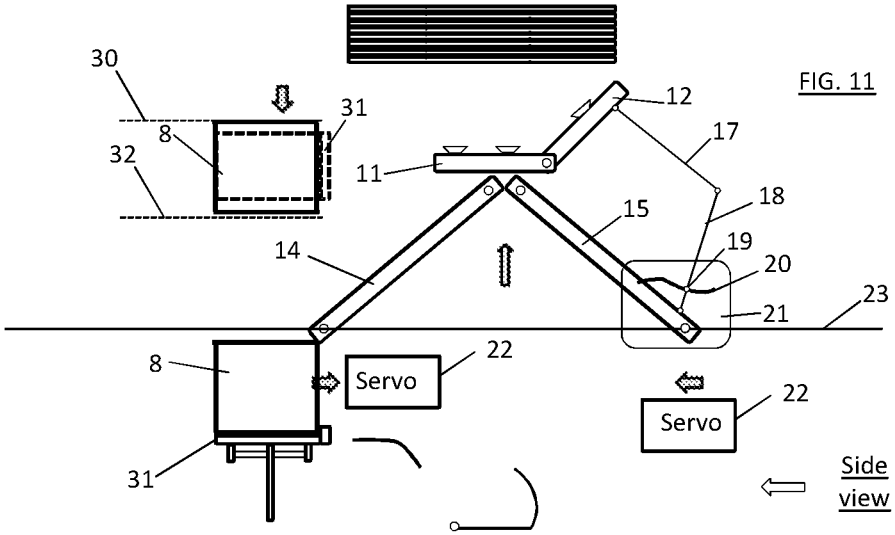
Figure 12:
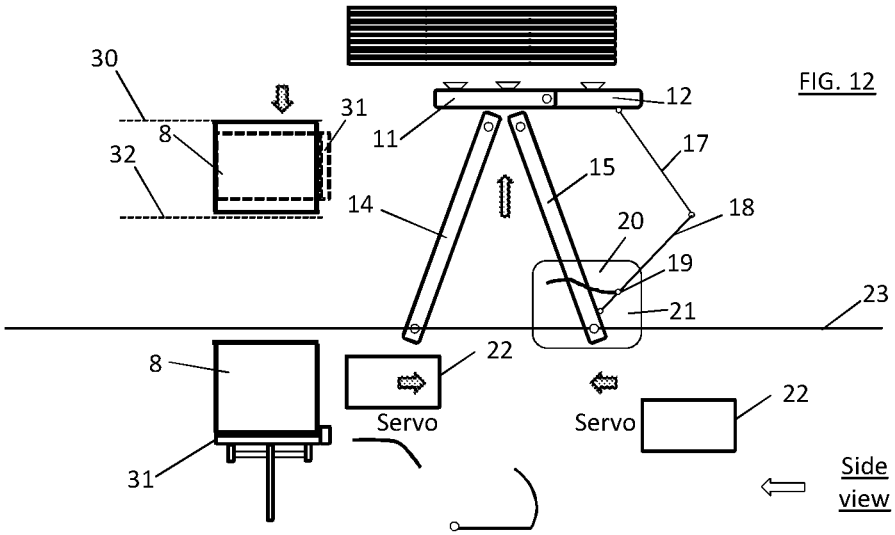
Figure 13:
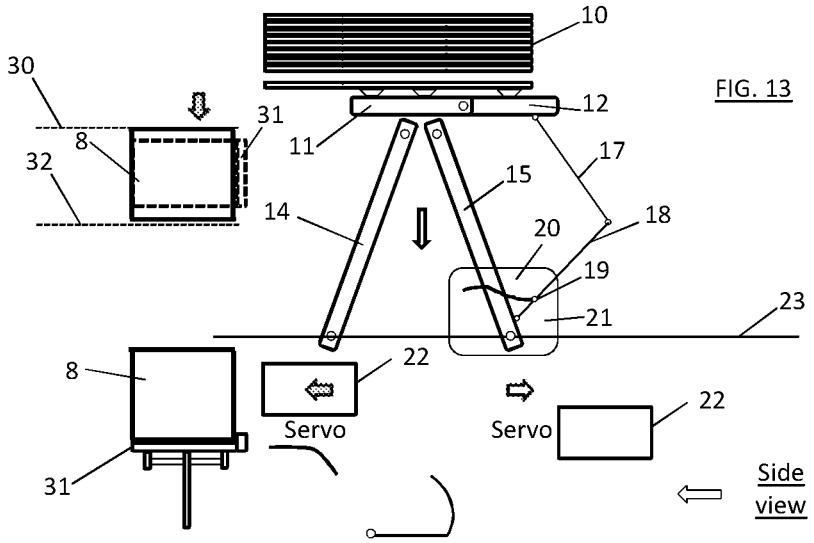

In FIG. 10, the gripper 11, 12 on the struts 14, 15 has returned to its initial position in the left-right direction as seen, below the case hopper 10. In FIG. 11, the driven ends of the struts 14, 15 are moved towards one another to raise the gripper 11, 12, with the arm 12 being rotated clockwise under constraint of the cam-controlled linkage 17, 18 until, as in FIG. 12, the plate 11 and arm 12 are once again in line and, as in FIG. 13, the vacuum suckers 13 are again activated to pick off the next case blank 1 from the hopper 10.

Figure 14:
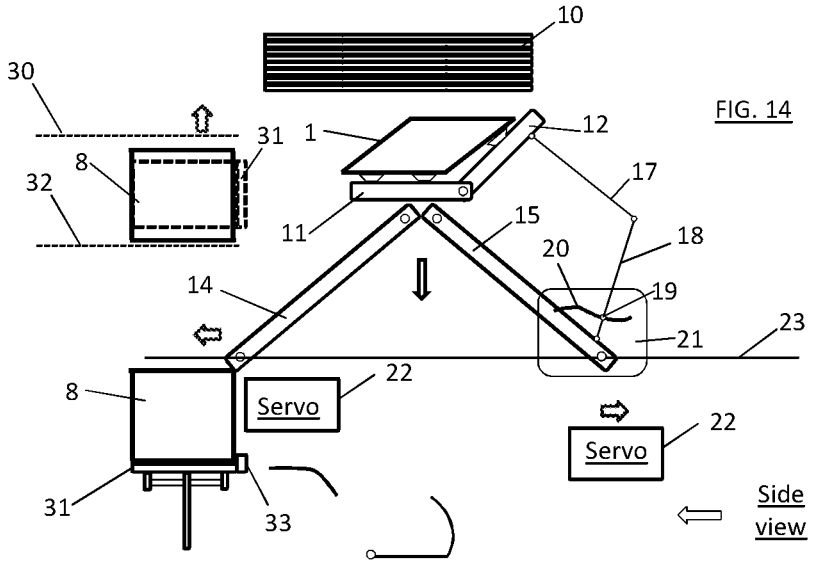

In FIG. 14, the unfolding mechanism 11, 12, 14, 15, 17, 18 and associated parts repeat the operation that has been described above to unfold the next case 8 and transport it to the packing station above the compression plate 31. As this is occurring, the case clamp 30 is released, to leave the previously erected and filled case 8 supported by the compression plate 31. As may be seen, the compression plate 31 has an upstand 33 at its rear edge, which engages the rear edge of the filled case 8.

Figure 15:
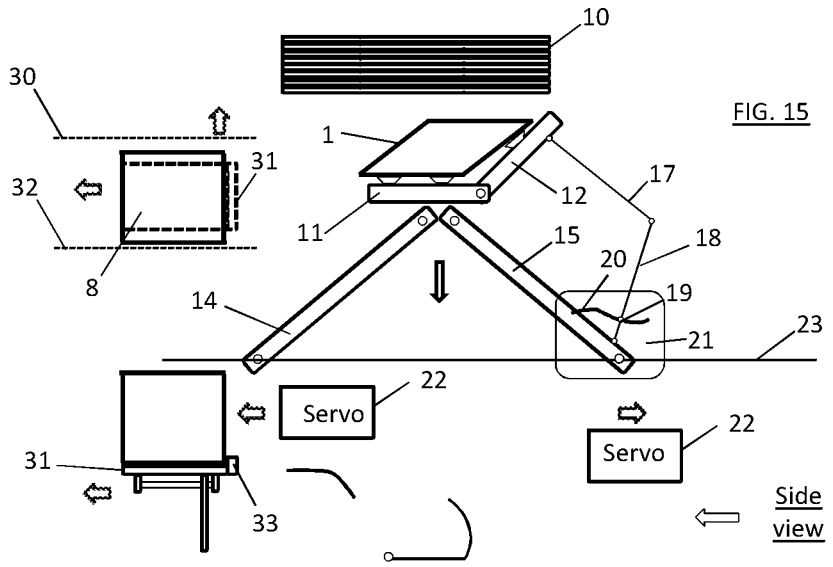
Figure 16:
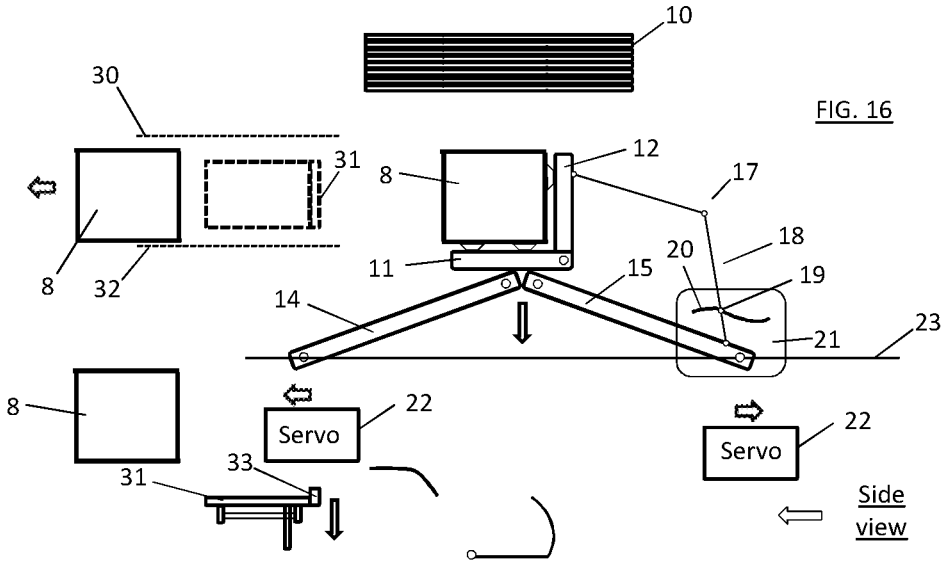
Figure 17:
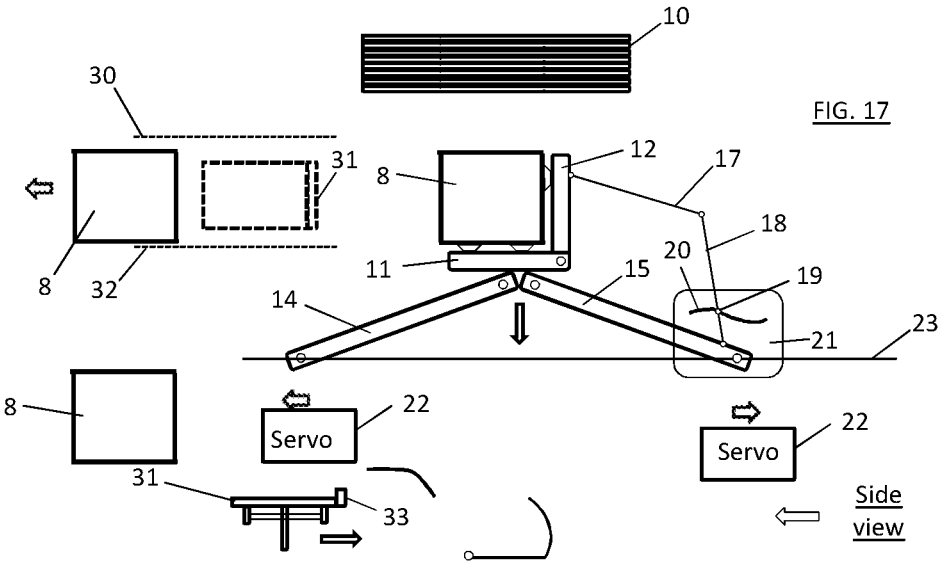

As shown in FIG. 15, the compression plate 31 is moved to the left as seen, by any suitable drive mechanism, thereby to eject the filled case 8 onto a conveyor (not shown) or any other location for further handling. The compression plate 31 is then moved downwardly, as shown in FIG. 16, and then to the right, as shown in FIG. 17, to resume its initial position, ready to receive the next case 8 which, by then, has been unfolded by the unfolding arm 12. It will be appreciated that the compression plate 31 follows a rectangular locus of movement for each case cycle.

The components of the illustrated case erecting apparatus may be of minimal size and mass—for example, at least partly of lightweight aluminium. Movement of the plate 11 and unfolding arm 12 on the struts 14, 15 is servo driven, such that the transport mechanism operates with two degrees of freedom, allowing movement of the gripper 11, 12 in two orthogonal or mutually transverse directions. Therefore, the apparatus may readily be designed to be operated at high speed, with smooth and quiet motion and with relatively gentle forces on the cases 8 as they are unfolded and handled. For example, an apparatus as illustrated may handle 20 cases per minute and more. As the folding mechanism is compact, the overall apparatus may be relatively narrow.

The gripper 11, 12 moves the cases 8 from hopper 10 to packing station (above the compression plate 31) in one grip. The unfolding of the case blanks 1 and erection of the cases 8 is accurate and repeatable, providing accurate (90°) case corners. Accurate positioning of the cases 8 facilitates packing without the need for significant product clearance in the case. An apparatus as illustrated may handle a large range of case sizes and handle a case joint (manufacturer's joint) at front or back. Usually, an erected case is wider at the end where the manufacturer's joint is located. With a belt transport, this usually means that the wider end should be at the rear of the case to allow the belt to grip. With a clamp, as illustrated, this is not necessary.

As a case blank 1 is unfolded whilst being picked from the hopper, all in one motion, this saves time and, as rotation of the unfolding arm 12 is synchronised to movement away from the hopper 10, the case blank 1 is completely unfolded with accuracy, regardless of the speed of pick (or pull).

It will be appreciated from the foregoing that the front and rear flaps 3 are folded, the side flaps 2 are part-folded and glue is applied to the side flaps 2, all whilst the case 8 is moving from its position where it is fully unfolded to its position where it is packed and in synchronisation with that movement.

Clamping of the case between the case clamp 30 and the fixed edge 32 maintains accurate position and squareness of the case 8, allows the mechanism 11, 12, 14, 15, 17, 18 to return for the next case blank 1 and holds the case 8 whilst it is packed. It is not necessary to transport the case 8 by side drive belts, which are typically used by other machines to transport a case from stage to stage through an erection process. Thus, there is no loss of position of the case 8 due to slippage with respect to side belts and no excess pressure on the sides of the case 8. As described above, once a case 8 is packed, it is simply ejected to its next location by forward movement of the compression plate 31, which entrains the packed case 8. Movement of the compression plate 31 can be by way of a very simple mechanism. Apparatus as described and illustrated can handle variations in case width without needing constant adjustment.

Whilst the illustrated apparatus is shown at one side of the hopper 10, it could equally well be provided at the opposite side, to accommodate case blanks 1 that are oppositely handed.

Figure 18:
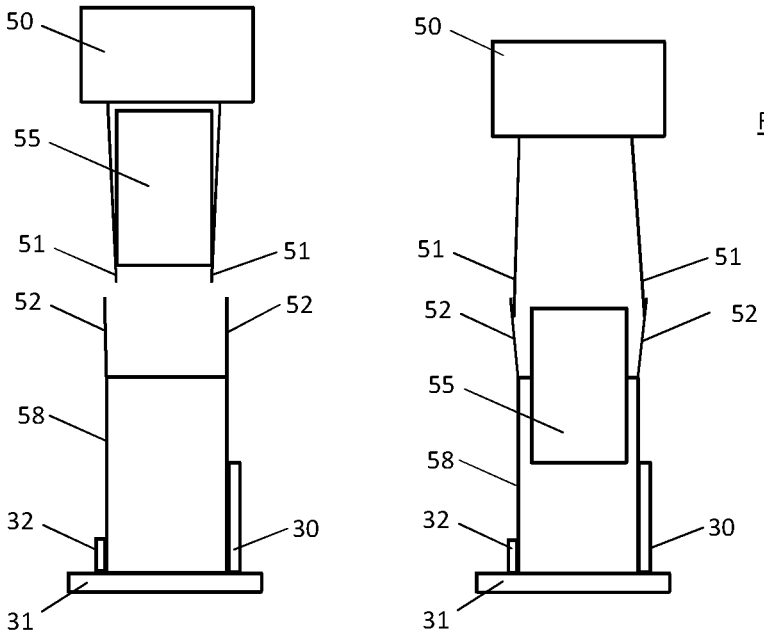
FIG. 18 illustrates a packing gripper in operation.

FIG. 18 shows a packing gripper 50 in operation with a case 58 of FEFCO 0201 style—that is, generally similar to the case 8 as described above but with closable top flaps as well as bottom flaps 2, 3.

At the left side of FIG. 18, the case 58 has been erected by a case erector as described above and is clamped between case clamp 30 and fixed edge 32, whilst supported on compression plate 31—as described generally above with reference to FIG. 9. The upper side flaps 52 of the case 58 stand upright. A stack 55 of products is gripped between arms 51 that are inclined slightly inwardly. As the packing gripper 50 is lowered, the lower ends of the arms 51 enter between the side flaps 52. As shown at the right side of FIG. 18, the gripper arms 51 are then moved slightly apart, to allow the stack 55 of products to drop into the case 58 whilst, at the same time, urging the opposing side flaps 52 apart.

The gripper 50 is then raised clear of the case 58, the top flaps of which may subsequently be closed by any suitable method, as may be known to the skilled reader.

If desired, the gripper 50 may be provided with a further pair of arms at the respective ends of the stack 55 of products, which operate in a similar way to the arms 51 but engage with the top front and rear flaps of the box 58, to maintain those flaps open whilst the products are dropped into the case 58.

In this specification, the verb "comprise" has its normal dictionary meaning, to denote non-exclusive inclusion. That is, use of the word "comprise" (or any of its derivatives) to include one feature or more, does not exclude the possibility of also including further features. The word "preferable" (or any of its derivates) indicates one feature or more that is preferred but not essential.

The reader's attention is directed to all papers and documents that are filed concurrently with or previous to this specification in connection with this application and which are open to public inspection with this specification, and the contents of all such papers and documents are incorporated herein by reference.

All or any of the features disclosed in this specification (including any accompanying claims, abstract and drawings), and/or all or any of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A packing case erecting apparatus, comprising:

a gripper having first and second jaws and gripping devices carried on said jaws and arranged to grip a case blank in a flat, folded condition;

a transport mechanism arranged to transport the gripper from a first position in which the gripper grips the case blank in a flat, folded condition to a second position in which the case is erected; and a rotation mechanism that is arranged to cause mutual rotation between said first and second jaws, thereby to unfold the case blank gripped by the gripper as the gripper is moved by the transport mechanism from its first to its second position:

wherein:

the gripping devices on said first and second jaws are aligned with one another when the gripper is in its first position;

the or each gripping device on said first jaw is oriented at a right angle to the or each gripping device on said second jaw when the gripper is in its second position;

the transport and rotation mechanisms are synchronised to cause mutual rotation between said first and second jaws by the rotation mechanism as the gripper is moved from its first to its second position by the transport mechanism, thereby to unfold the case blank gripped by the gripper; and the transport mechanism comprises a pair of drives and a pair of struts that are connected to the gripper at one end of the struts, each strut having another, driven end that is driven independently of the other strut by a respective one of the drives.

2. An apparatus according to claim 1, wherein said driven ends of the struts are constrained to travel along a slideway.

3. An apparatus according to claim 1, wherein said transport mechanism is connected to said rotation mechanism.

4. An apparatus according to claim 3, comprising a linkage that connects said transport mechanism and said rotation mechanism and includes a cam follower that is arranged to follow a cam surface to synchronise mutual rotation between said first and second jaws with movement of the gripper between its first and second positions.

5. An apparatus according to claim 4, wherein said cam surface is arranged to move with a part of the transport mechanism.

6. An apparatus according to claim 1, wherein said gripping devices comprise vacuum suckers.

7. An apparatus according to claim 1, wherein said first and second jaws are pivotally connected to one another.

8. An apparatus according to claim 1, further comprising a hopper adjacent said first position, for containing a stack of case blanks in a flat, folded condition.

9. An apparatus according to claim 1, wherein said transport mechanism operates with two degrees of freedom such that movement of the gripper from its first position to its second position comprises movement in a first direction followed by movement in a second direction transversely of the first direction.

10. An apparatus according to claim 9, wherein said driven ends of said struts are driven in opposite directions to achieve movement of said gripper in said first direction; and said driven ends of said struts are driven in a common direction to achieve movement of said gripper in said second direction.

11. An apparatus according to claim 1, wherein said driven ends of said struts are servo driven.

12. An apparatus according to claim 1, further comprising one or more flap closing device arranged to close bottom flaps of an erected case as it is transported towards its second position.

13. An apparatus according to claim 12, wherein one said flap closing device comprises a plate mounted on a parallel linkage and arranged to support a rear flap of an erected case as it is transported towards its second position.

14. An apparatus according to claim 1, further comprising an adhesive applicator arranged to apply adhesive to bottom flaps of an erected case as it is transported towards its second position.

15. An apparatus according to claim 1, further comprising a compression plate adjacent said second position and arranged to apply pressure to closed, bottom flaps of an erected case at said second position.

16. An apparatus according to claim 15, wherein said compression plate comprises an upstand arranged to engage the bottom of an erected case at said second position.

17. An apparatus according to claim 16, further comprising a transport device arranged to transport said compression plate in synchronisation with said transport mechanism.

18. An apparatus according to claim 17, wherein said transport device is arranged to transport said compression plate such that said upstand entrains the bottom of an erected case at said second position and transports the erected case to a location for subsequent handling.

19. An apparatus according to claim 1, further comprising a case clamp and a fixed edge at said second position, arranged to clamp an erected case therebetween.

20. An apparatus according to claim 1, wherein said second position is a packing station at which products are packed in an erected case.

21. An apparatus according to claim 1, wherein the or each gripping device on at least one of said jaws is mounted for sliding movement along the jaw.

22. An apparatus according to claim 1, wherein said gripper grips a case along a side face and an end face of the case.

23. A method of erecting a packing case, using an apparatus according to claim 1, comprising the steps of gripping the case blank in a flat, folded condition at said first position and transporting the case blank to said second position whilst rotating said first and second jaws to erect the case.

24. A method according to claim 23, wherein said second position is a packing station at which products are packed in an erected case, and the method comprises the further step of packing products in the erected case when at said second position.

* * * * *